US007044172B2

(12) United States Patent
Stewart

(10) Patent No.: US 7,044,172 B2
(45) Date of Patent: May 16, 2006

(54) APPARATUS AND METHOD FOR SUPPLYING TUFTS OF YARN

(75) Inventor: Richard Stewart, Co. Down (GB)

(73) Assignee: Ulster Carpet Mills (Holdings) Limited, Craigavon (GB)

( * ) Notice: Subject to any disclaimer, the term of this patent is extended or adjusted under 35 U.S.C. 154(b) by 0 days.

(21) Appl. No.: 10/381,067

(22) PCT Filed: Aug. 31, 2001

(86) PCT No.: PCT/GB01/03913

§ 371 (c)(1),
(2), (4) Date: Jul. 23, 2003

(87) PCT Pub. No.: WO02/24994

PCT Pub. Date: Mar. 28, 2002

(65) Prior Publication Data

US 2004/0035340 A1 Feb. 26, 2004

(30) Foreign Application Priority Data

Sep. 19, 2000 (GB) ..... 0022939.3

(51) Int. Cl.
*D03D 39/00* (2006.01)

(52) U.S. Cl. ..... 139/7 A; 139/7 C

(58) Field of Classification Search ..... 139/2, 139/7 R, 7 A, 7 F, 7 D, 7 B, 7 C
See application file for complete search history.

(56) References Cited

U.S. PATENT DOCUMENTS 5,743,306 A * 4/1998 Stewart et al. ..... 139/7 A
5,806,568 A * 9/1998 Dewispelaere et al. ..... 139/2
6,701,970 B1 * 3/2004 Burton ..... 139/7 A
6,820,656 B1 * 11/2004 Burton ..... 139/7 A

* cited by examiner

*Primary Examiner*—Rodney Lindsey
*Assistant Examiner*—Andrew W. Sutton
(74) *Attorney, Agent, or Firm*—Dann, Dorfman, Herrell and Skillman; Henry H. Skillman

(57) ABSTRACT

Apparatus for loading a row of tuft retention sites (TRS) in a gripper loom with a row of tufts (T) arranged in a predetermined pattern sequence, the apparatus including a group of yarn sources movable along said row tuft retention sites (TRS), drive means for sequentially moving said group of yarn sources along the guide means (33) and temporarily locating a desired yarn source in registry with a predetermined tuft site (TRS), and selectively operable tuft forming means which, on selection, transfer a tuft (T) from said desired yarn sources to said predetermined tuft site (TR).

8 Claims, 4 Drawing Sheets

APPARATUS AND METHOD FOR SUPPLYING TUFTS OF YARN

The present invention relates to apparatus and method for supplying tufts of yarn to grippers of a gripper loom, in particular but not exclusively, an Axminster gripper loom.

In our European patent 0759101 we describe an apparatus and method for loading a tuft carrier using a reduced number of yarn sources.

The present invention similarly aims to provide, for each pick in the weaving cycle of a gripper loom, a row of tufts of a predetermined pattern sequence the tufts being sourced from a reduced number of yarn supplies.

According to one aspect of the present invention there is provided apparatus for loading a row of tuft retention sites in a gripper loom with a row of tufts arranged in a predetermined pattern sequence, the apparatus including a group of yarn sources movable along said row of tuft retention sites, drive means for sequentially moving said group of yarn sources along the guide means and temporarily locating a desired yarn source in registry with a predetermined tuft site, and selectively operable tuft forming means which, on selection, transfer a tuft from said desired yarn sources to said predetermined tuft site.

Various aspects of the present invention are hereinafter described with reference to the accompanying drawings, in which.

Figure 1:
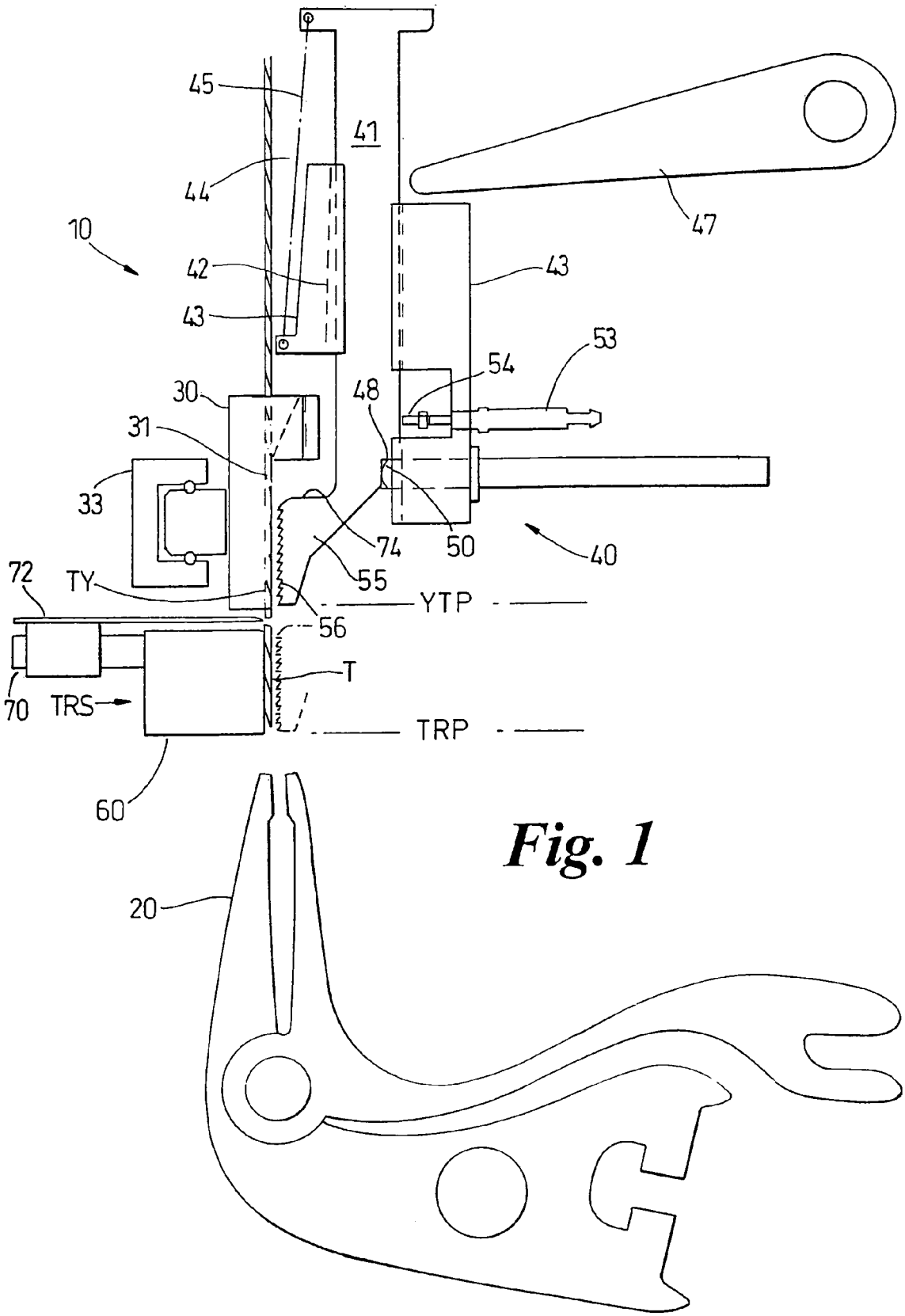
FIG. 1 is a schematic end view of a loading apparatus according to an embodiment of the present invention.
Figure 3:
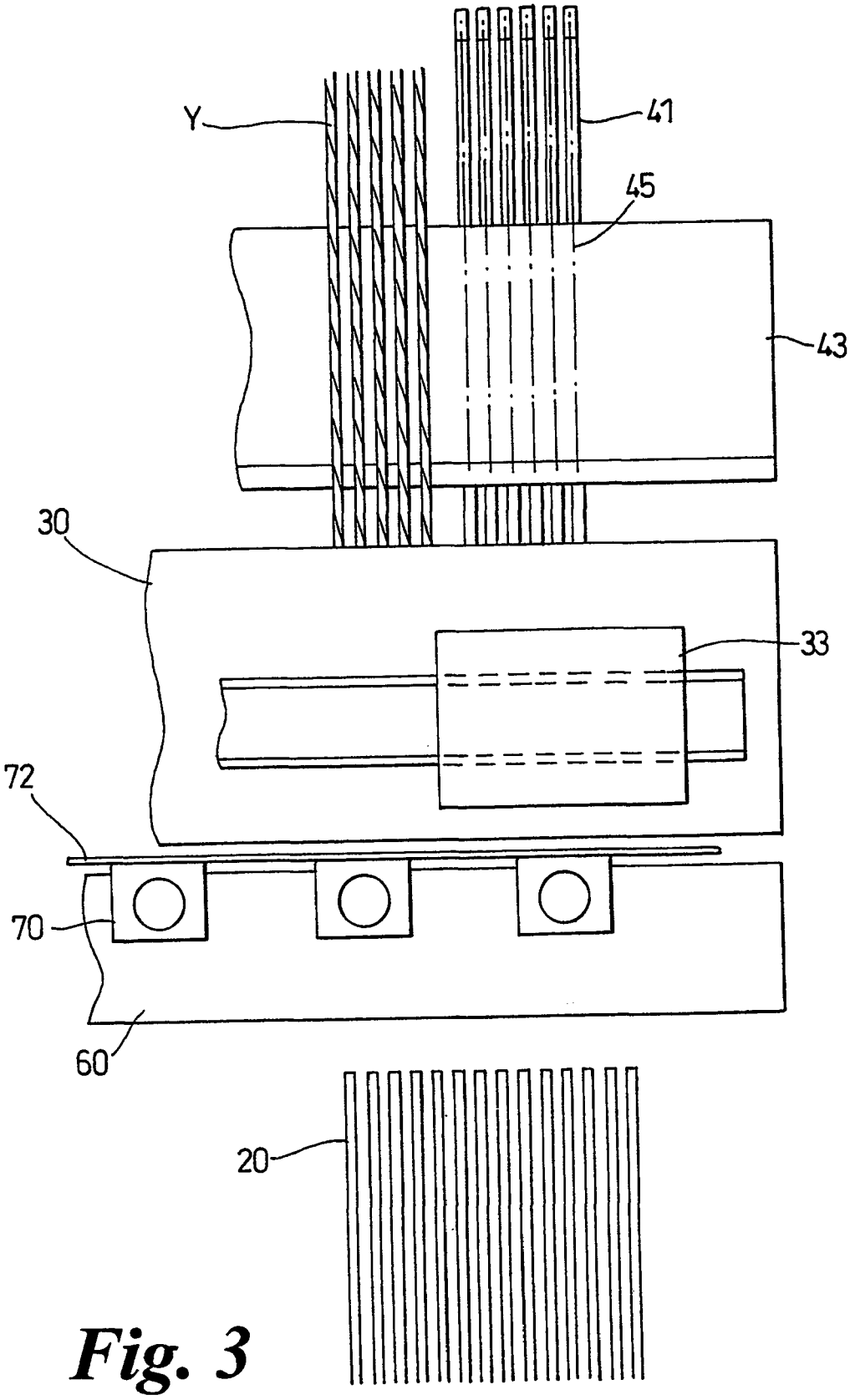
FIG. 3 is a partial front view of the apparatus shown in FIG. 1.

Referring initially to FIG. 1 there is illustrated a tuft loading apparatus 10 according to an embodiment of the present invention which is mounted in a gripper loom above a row of tuft grippers 20.

As is known, each of the tuft grippers 20 is movably mounted in the frame of the loom for movement between a tuft collection position (as illustrated in FIG. 1), whereas the gripper 20 is able to collect a tuft T from a tuft retention site TRS, and a tuft delivery position whereat the gripper deposits the tuft T into the carpet being woven on the loom.

Accordingly across the width of the loom, a row of tuft retention sites TRS is provided, the number of sites in said row corresponding in number to the number of grippers 20; the sites TRS being spaced along the row of the grippers by the same pitch spacing as the pitch spacing between the grippers. This is diagrammatically shown in FIGS. 4 and 5

The apparatus 10 includes a yarn carrier 30 which is arranged to be movable along the row of retention site TRS. Preferably the carrier 30 is slidingly mounted in a rail 33 which extends across the loom.

The yarn carrier 30 includes a plurality of yarn guide passageways 31 spaced along the carrier 30 so that the carrier 30 may be moved along the row of sites TRS to a succession of transfer positions whereat desired yarn guide passageways 31 are located in registry with predetermined sites TRS.

Preferably the pitch spacing between the yarn guide passageways 31 is the same as, or a multiple of the pitch spacing between the sites TRS so that at each successive transfer position of the carrier 30, each yarn guide passageway 31 on the carrier 30 is located in registry with a tuft retention site TRS.

Figure 4:
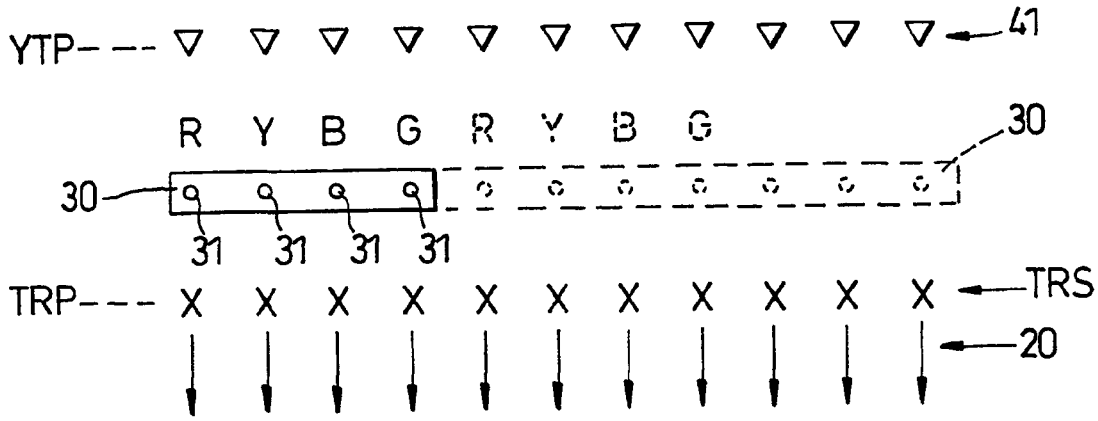
FIG. 4 shows, diagrammatically, a preferred arrangement of the apparatus of FIG. 1.
Figure 5:
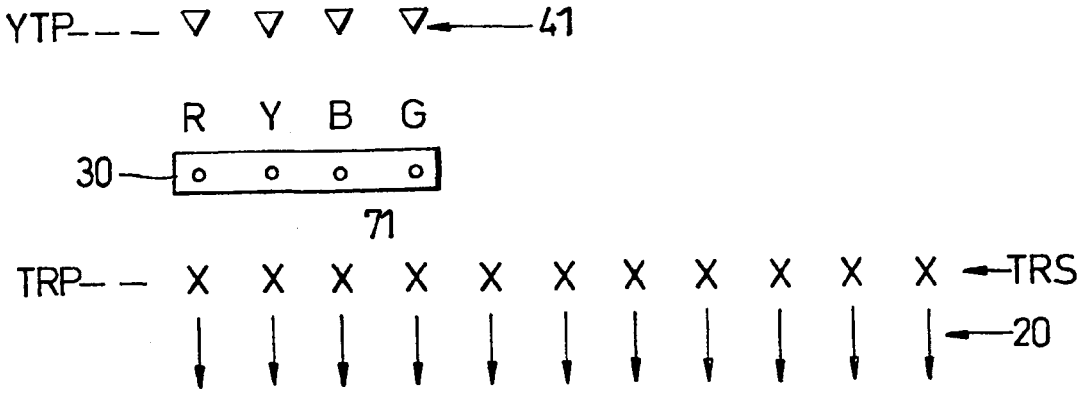
FIG. 5 shows, diagrammatically, an alternative arrangement of the apparatus of FIG. 1.

In the example diagrammatically illustrated in FIGS. 4 and 5, the carrier 30 is shown as having four guides 31, each being supplied with a yarn having a different character, for example the yarns are of different colours R (Red), Y (Yellow), B (Blue) and G (Green).

When the carrier 30 is located at a transfer position, the carrier 30 co-operates with a yarn feeder assembly 40 which acts to engage selected yarns in yarn guide passageways 31 to draw lengths of yarn downwardly to predetermined tuft retention sites TRS.

Preferably the yarn feeder assembly 40 includes a plurality of selectively movable yarn feeder fingers 41 arranged in a row so that each finger 41 is in registry with a corresponding tuft retention site TRS.

Each finger 41 is slidingly guided in a slot 42 formed in a guide bar 43 for reciprocal movement between a yarn transfer position YTP (as shown in solid lines in FIG. 1) and a tuft retention position TRP (as shown in broken lines in FIG. 1).

Each finger 41 is biased to its tuft retention position TRP by resilient biasing means 44 (preferably in the form of a spring 45) and is movable to its yarn transfer position YTP by a pivotally movable reset lever 47.

Each finger 41 is retained in its yarn transfer position by engagement of a latch shoulder 48 formed on finger 41 abutting against a stop 50.

The stop 50 is preferably slidably mounted in bar 43 to enable it to be retracted from the finger engaged position (as shown in FIG. 1) to a retracted position where at the stop is spaced from the finger 41.

Each finger 41 is provided with a selectively operable actuator 53, typically in the form of a pneumatically or electromagnetically powered piston 54, which on actuation engages the finger 41 to cause it to tilt forwardly thereby disengaging latch shoulder 48 from the static stop 50 and causing the finger 41 to move to its tuft retention position under the influence of biasing means 44.

Each finger 41 includes a yarn engagement head portion 55 which includes a yarn gripping formation 56 formed on its side facing the yarn carrier 30.

Each yarn guide passageway 31 is preferably defined by an open topped channel, the open top of which is opposed to the yarn gripping formation 56 of a finger 41 which is in registry with the yarn guide passageway 31.

Each finger 41 is arranged such that when it is tilted forwardly by the actuator 53, the yarn gripping formation 56 enters into the yarn guide groove to engage the yarn TY located therein.

The actuator 53 is arranged to hold the finger 41 at its forwardly tilted position as it moves to its tuft retention position in order to maintain gripping contact between the yarn TY and the gripping formation 56.

Preferably located below the yarn carrier 30 is a tuft retention site bar 60 against which each finger 41 abuts to hold a tuft T in readiness for collection by a gripper 20. Accordingly, with the present embodiment, the bar 60 and feed fingers 41 in combination function as a tuft carrier holding a row of tufts for transfer to the grippers 20.

Yarn severing means 70 are provided, located between the carrier 30 and bar 60 for severing the drawn down yarn TY to create a tuft T.

Preferably the severing means 70 includes a movable blade 72 which co-operates with a cutter edge 74 formed on each finger 41 to thereby enable a scissor-type severing action.

Figure 2:
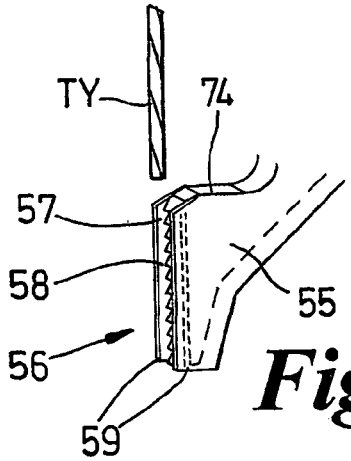
FIG. 2 is a partial sectional view of a yarn feeder finger shown in FIG. 1.

The yarn gripping formation 56 is preferably defined by a channel 57 having a bottom formed by a series of serrations or teeth 58. As shown in FIG. 2, the sides 59 of the channel are spaced apart and are of a depth sufficient to accommodate the yarn. Accordingly, during severing of the yarn, the channel 57 acts to constrain spread of the yarn and facilitates obtaining a cleanly cut yarn end.

In use, at the beginning of a weaving cycle, all feed fingers 41 are located at their yarn transfer position YTP.

The yarn carrier 30 is moved between and temporarily held at successive transfer positions by drive means (not shown) such as a cam operated mechanism or a stepper motor.

When at a transfer position, control means (such as a computer controlled pattern control means) monitors the position of the carrier 30 and actuates one or more of the actuators 53 associated with feed fingers 41 which are in registry with predetermined yarn guide passageways 31. Actuation of the actuators 53 causes the associated finger 41 to be moved forwardly to disengage shoulder 48 from stop 50 and so causes a desired yarn TY to be drawn down and transferred to a tuft retention site TRS. The severing means 70 are then actuated to create tufts T from the drawn down yarn.

The feed fingers 41 responsible for drawing down yarn TY are now located at their tuft retention positions TRP. The carrier 30 is now moved to its next transfer position and the process is repeated.

By repeating the process several times, each yarn guide passageway 31 may be presented to a predetermined number of feeder fingers 41 and thereby enable a full row of tufts T held at retention sites TRS to be created.

The weaving cycle is then completed to cause the grippers to move the tufts into the carpet being woven. At the end of the weaving cycle, lever 47 is actuated to raise all fingers 41 to their yarn transfer YTP in readiness for the next weaving cycle.

Prior to actuation of lever 47 to raise the fingers 41, the stop 50 is moved rearwardly to its retracted position. This enables the fingers 41, under the influence of the spring 45 to move rearwardly and so space the yarn gripping formation 56 away from the bar 60 and also away from the yarn guide channel 31. This enables the fingers to rise without contacting yarn TY located in the yarn guide channels 31.

Once the fingers 41 have been moved to their yarn transfer position YTP, the stop 50 is advanced to its finger engaged position for engagement with shoulder 48.

As indicated in FIG. 4, the yarn carrier 30 may extend across the full width of the loom so as to provide a row of yarn guide passageways 31 corresponding in number to the number of tuft retention sites TRS. The yarn guide passageways 31 are fed with a repeating sequence of yarns (in the example RYBG repeat) to define groups of yarns spaced along the carrier 30.

The number of different yarns defining each group determines the number of successive transfer positions the carrier 30 has to undergo in order to deliver each different yarn to a given tuft retention site. In the example given where there are four different yarns in each group, then carrier needs to be moved in one direction from a rest position to 3 successive positions (spaced by the pitch of the tuft retention sites).

An alternative embodiment is diagrammatically illustrated in FIG. 5.

In FIG. 5, the number of feeders 41 corresponds in number to the number of yarn guide passageways 31. The feeders 41 are arranged to be moved in synchronism with the carrier 30 as the carrier moves from one transfer position to the next transfer position.

Since the feeders 41 move together with the carrier 30 across the loom, they do not function to remain at their tuft retention positions TRP to hold tufts T in readiness for transfer to the grippers. Instead, the bar 60 is adapted, for example by the provision of slots, to retain tufts T in a similar manner to a conventional tuft carrier. Accordingly after each finger 41 has moved to its tuft retention position TRP it immediately returns to its yarn transfer position leaving the tuft attached to a retention site TRS formed in the bar 60.

Figure 6:
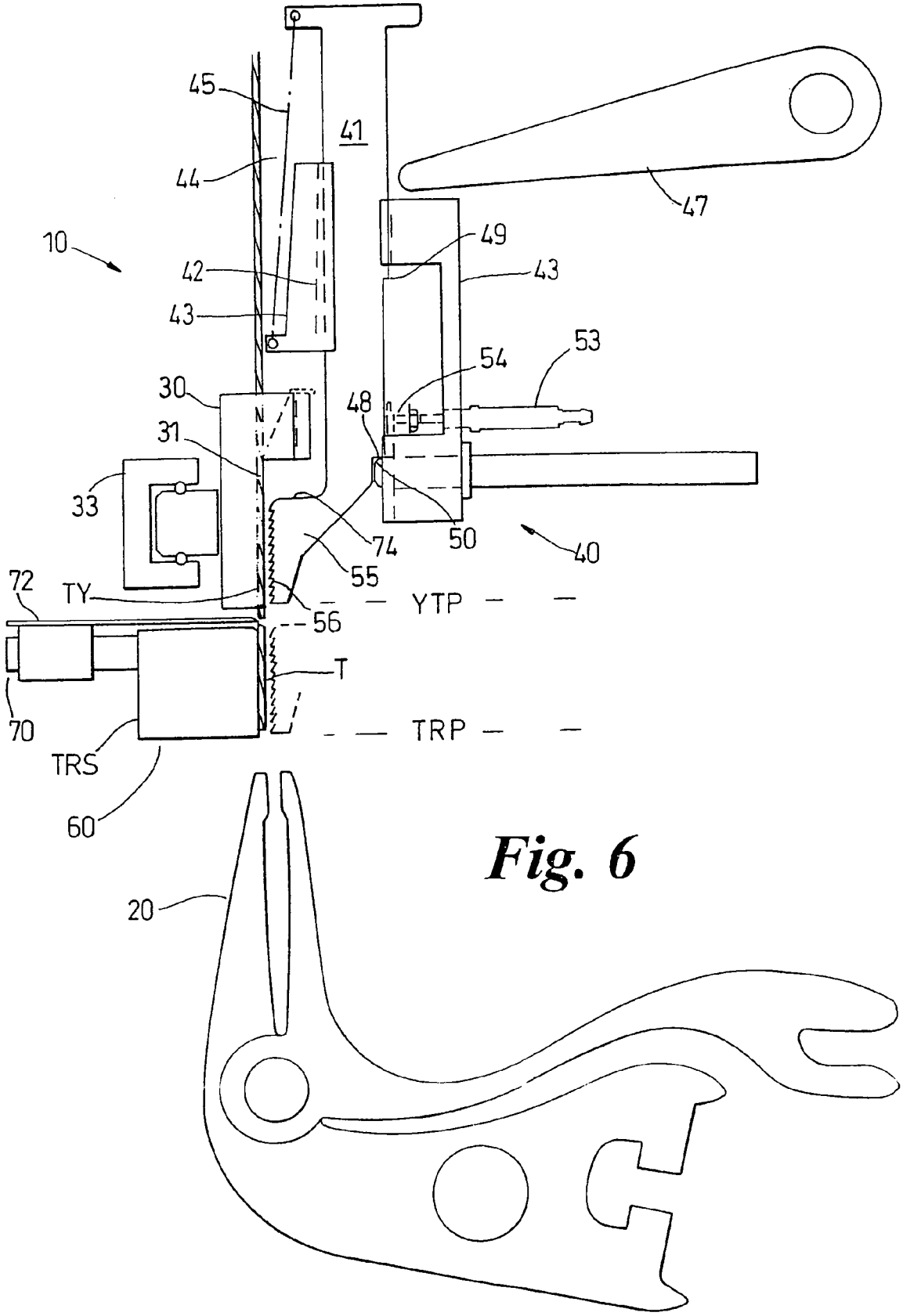
FIG. 6 is a similar view to FIG. 1 of a further embodiment according to the present invention.

A further embodiment is illustrated in FIG. 6 which is similar to the embodiment of FIG. 1.

Accordingly appropriate, similar parts have been designated by the same reference numerals.

In the embodiment of FIG. 6 each finger 41 is provided with additional an latch shoulder 49 which is co-operable with corresponding finger 41 during its downward movement after the actuator 53 has been actuated to move the finger 41 forwardly to disengage latch shoulder 48 from stop 50.

Engagement of shoulder 49 arrests downward movement of the corresponding finger 41 at a position corresponding to the position required for knife 72 to co-operate with upper edge 74 of the finger 41 to sever the yarn.

the finger 41 may reside at this position, held by actuator 53 until completion of the weaving cycle.

Alternatively, after severing of the yarn to form tuft T, the actuator 53 may be retracted to disengage from latch shoulder 49 and enable the finger 41 to fall a small distance into engagement with a stop (not shown) in order to hold the finger at a tuft retention position TRP. The small distance travelled is chosen to be sufficient to enable edge 74 to be spaced from the cutter blade 72 and so save wear on the cutter blade 72 which in practice will probably be continuously reciprocated.

The invention claimed is:

1. Apparatus for loading a row of tuft retention sites in a bar of a gripper loom with a row of tufts arranged in a predetermined pattern sequence, the apparatus including a carrier having a row of yarn transfer sites and a group of yarn sources movable along said row of tuft retention sites, drive means for sequentially moving said group of yarn sources along said row of tuft retention sites and temporarily locating a desired yarn source in registry with a predetermined tuft retention site, and a group of selectively operable tuft forming means corresponding in number to the number of yarn sources in said group, said group of tuft forming means being movable along said row of tuft retention sites together with said group of yarn sources, on selection each tuft forming means of said group being arranged to deposit a tuft into said predetermined tuft retention site.

2. Apparatus for loading a row of tuft retention sites in a bar of a gripper per loom with a row of tufts arranged in a predetermined pattern sequence, the apparatus including a carrier having a row of yarn transfer sites and a group of yarn sources movable along said row of tuft retention sites, drive means for sequentially moving said group of yarn sources along said row of tuft retention sites and temporarily locating a desired yarn source in registry with a predetermined tuft retention site, and a group of selectively operable tuft forming means corresponding in number to the number of tuft retention sites, each tuft forming means of said group, when selected, being arranged to transfer a tuft from said desired yarn source to said predetermined tuft retention site.

3. Apparatus according to claim 2 for a gripper loom having a gripper for each tuft retention site, wherein each tuft forming means of said group, when selected, is arranged to transfer a tuft from said desired yarn source and retain said tuft at said site until collected by a gripper of the loom.

4. Apparatus according to claim 2, wherein a plurality of groups of yarn sources are arranged in succession along said row of tuft retention sites, said drives means being operable to move said plurality of groups in unison in a predetermined sequence into temporary registry with said tuft retention sites.

5. A gripper loom having a row of tuft grippers including apparatus according to claim 2, wherein said tuft retention sites correspond to said row of tuft grippers.

6. Apparatus according to claim 1 for a gripper loom having a gripper for each tuft retention site, wherein each tuft forming means of said group, when selected, is arranged to transfer a tuft from said desired yarn source and retain said tuft at said site until collected by a gripper of the loom.

7. Apparatus according to claim 1, wherein a plurality of groups of yarn sources are arranged in succession along said row of tuft retention sites, said drives means being operable to move said plurality of groups in unison in a predetermined sequence into temporary registry with said tuft retention sites.

8. A gripper loom having a row of tuft grippers including apparatus according to claim 1, wherein said tuft retention sites correspond to said row of tuft grippers.

* * * * *